United States Patent [19]

Caruso

[11] 4,319,223

[45] Mar. 9, 1982

[54] FULL CODE MEANS FOR ELECTROMECHANICAL DECODER

[75] Inventor: Peter J. Caruso, Wayne, N.J.

[73] Assignee: The Bendix Corporation, Teterboro, N.J.

[21] Appl. No.: 468,998

[22] Filed: Jul. 1, 1965

[51] Int. Cl.[3] ..... E05B 37/00; E05B 45/06

[52] U.S. Cl. ..... 340/347 P; 70/313; 340/543

[58] Field of Search ..... 340/164, 365; 35/3, 35/4; 70/213, 214, 288, 297, 299, 313, 333

[56] References Cited

U.S. PATENT DOCUMENTS

| | | | |
|---|---|---|---|
| 2,568,264 | 9/1951 | Zenner | 340/164 A |
| 2,947,974 | 8/1960 | Stickel | 340/164 R |
| 3,074,051 | 1/1963 | Penningroth | 340/164 A |

*Primary Examiner*—David H. Brown

*Attorney, Agent, or Firm*—Anthony F. Cuoco; Vett Parsigian

[57] ABSTRACT

A decoder mechanism comprising a code wheel assembly including an inner wheel element and an outer wheel element, means for locking the inner wheel element to the outer wheel element in driving relation, means selectively operable for actuating said locking means in locking and unlocking senses, other means selectively operable for changing the locking and unlocking senses of said locking means, and said other means including means effective to transfer from said one unlocking sense to said other unlocking sense upon actuation of said locking means in said one unlocking sense.

3 Claims, 8 Drawing Figures

CODE POST IN NEUTRAL POSITION MARK ORIENTED

CODE POST CHANGED TO MARK POSITION WITH MARK ORIENTATION TO EFFECT CHANGE TO SPACE ORIENTATION

CODE POST CHANGED TO SPACE POSITION WITH MARK ORIENTATION

FULL CODE MEANS FOR ELECTROMECHANICAL DECODER

This invention relates to an improved full code change means for an electromechanical decoder and more particularly to a novel means for effecting a full code change in an electromechanical decoder of a type disclosed and claimed in copending U.S. Applications Ser. No. 306,792, filed Sept. 4, 1963; Ser No. 328,083, filed Dec. 4, 1963; Ser. No. 338,483, filed Jan. 17, 1964; Ser. No. 371,072, filed May 28, 1964, and Ser. No. 377,729, filed June 24, 1964, all of which applications have been filed by Peter J. Caruso, the inventor of the present invention, and assigned to The Bendix Corporation, assignee of the present invention.

Furthermore, the present invention relates to a novel means for the insertion of an actual new code into an electromechanical decoder so as to accomplish a code change therein.

Another object of the invention is to provide a novel means whereby the new code may be repeatedly inserted in an electromechanical decoder in the event of initial failure so as to successfully accomplish code change and avoid the effects of extraneous transients during a code change operation.

Another object of the invention is to provide a full code change system by suitable modification of the code post pinions by the provision of suitable cut-out sections of the pinions so arranged that while each of the code posts may be initially angularly oriented selectively in first and second senses, it should be noted that upon a given code post being longitudinally actuated properly in a sense to render one of the angularly oriented senses effective to disengage the inner code wheel from the outer code wheel, the pinion gear of the given code post may be then angulary actuated by the sector gear so as to change the angular orientation of the code post from the one to the other sense. However, upon the given code post being longitudinally actuated in a sense to render the angularly oriented sense thereof ineffective to disengage the inner code wheel from the outer code wheel, the effective cut-out section of the pinion will render the sector gear ineffective to change the angular orientation thereof.

These and other objects and features of the invention are pointed out in the following description in terms of the embodiments thereof which are shown in the accompanying drawings. It is to be understood, however, that the drawings are for the purpose of illustration only and are not a definition of the limits of the invention. Reference is to be had to the appended claims for this purpose.

IN THE DRAWINGS

Figure 1:
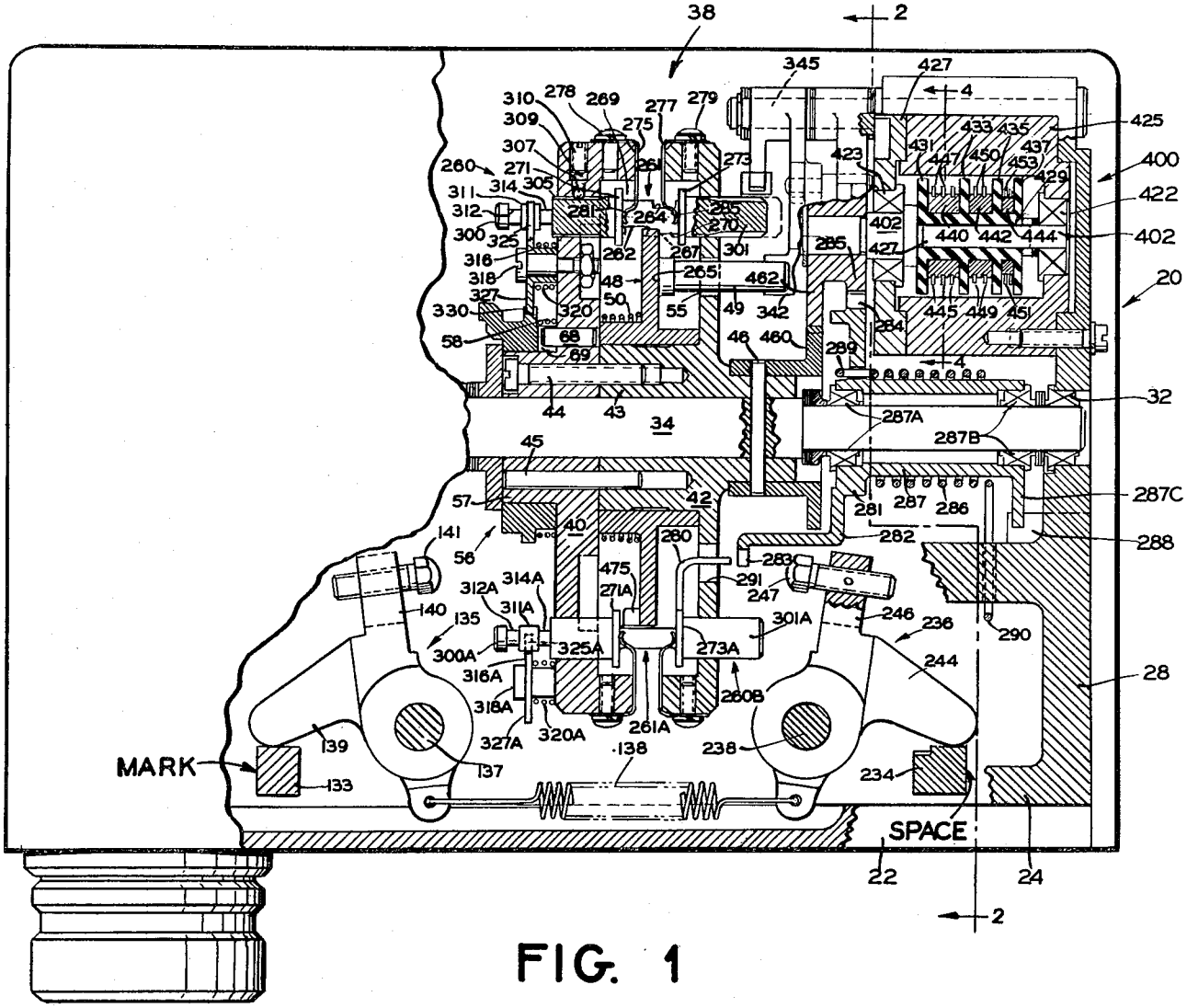
FIG. 1 is a partial sectional view of an electromechanical decoder embodying the operating mechanism of the present invention.

Referring to the drawing of FIG. 1, a decoder mechanism of the type such as disclosed in the copending U.S. application Ser. No. 371,072, filed May 28, 1964, and Ser. No. 377,729, filed June 24, 1964, is shown housed in a casing 20 having a base 22 to which may be fastened a bulkhead 24. There may project from the bulkhead 24 opposite end portions, one of which is indicated at 28, and in which there may be rotatably mounted a shaft 34 on bearings carried by the opposite end portion and bearings 32 carried by the end portion 28. The decoder shaft 34 has secured thereto by a key a ratchet wheel, shown in the aforenoted application Ser. No. 371,072, and there is further secured to shaft 34 a code wheel assembly 38, shown in FIG. 1.

The code wheel assembly 38, as shown in FIG. 1, includes outer wheel elements 40 and 42. The outer wheel element 42 has an annular bearing 43, as shown in FIG. 1, which is secured to the outer wheel element 40 by a bolt 44 and pin 45. The outer wheel elements 40 and 42 and bearing 43 are in turn secured to shaft 34 by a pin 46. Angularly movable on bearing 43 and within the outer wheel elements 40 and 42 is an inner wheel element 48 operatively connected to outer wheel element 40 by a light coupling spring 50 connected at one end to the inner wheel element 48 and at the opposite end to the outer wheel element 40. There projects from the inner wheel element 48 a pin 49 which is normally biased by the preload of the coupling spring 50 in an arcuate slot 55 provided in the outer wheel element 42 and in a direction corresponding to the direction of actuation of the ratchet wheel carried by the shaft 34, as explained in the aforenoted copending application Ser. No. 371,072.

Further, as shown in FIG. 1, there is angularly movable on a bearing 57 a reset wheel 56 operatively connected to the outer wheel element 40 by a coupling spring 58. The coupling spring 58 is connected at one end in the outer wheel element 40 and at an opposite end in the reset wheel 56 so as to bias the reset wheel 56 in a direction opposite from that of the direction of actuation of the outer wheel elements 40–42 by the ratchet wheel, as explained in the application Ser. No. 371,072.

Thus, in the form of the invention shown structurally in FIG. 1, a pin 68 projects from the outer wheel element 40 into a slot 69 in the reset wheel 56. The slot 69 cooperates with the pin 68 to limit the movement of the reset wheel 56 under the biasing force of spring 58.

As explained in the copending application Ser. No. 371,072, actuation of the mechanism is accomplished by two stepping solenoids, designated "Mark" and "Space". Power for these solenoids is supplied by a three wire system which permits selective energization of either solenoid.

Solenoid motion is translated into wheel rotation through a series of linkages and a ratchet assembly. The ratchet assembly consists of two advance ratchets, one for each solenoid drive system and a reverse ratched used for precise wheel positioning and overstep prevention at each station.

Energizing either solenoid advances the wheel one step and actuates the corresponding code post through suitable operating levers and knocker arms. Thus, the "Mark" stepping solenoid upon the energization thereof actuates an arm having an end portion 133, shown structurally in FIG. 1, and arranged to operatively engage a knocker arm 135 pivotally mounted on a pin 137 carried by a flange projecting from the base 22. The knocker arm 135 is biased by a spring 138 so as to maintain an end portion 139 thereof in operative engagement with the end portion 133 of the actuating arm while another end portion 140 of the knocker arm 135 has adjustably mounted thereon a knocker belt 141 which upon energization of the "Mark" solenoid may be actuated into operative engagement with end portions 300 and 300A of the slidable main code posts 260 and switch control code posts 260A, 260B and 260C carried by the outer wheel elements 40 and 42 of the code wheel aassembly 38 to longitudinally actuate the code posts in one sense to effect the selective operation thereof, as heretofore explained in the aforenoted application Ser. No. 306,792, filed Sept. 5, 1963, by Peter J. Caruso, and assigned to The Bendix Corporation.

Further, the "Space" stepping solenoid upon the energization thereof actuates an arm having an end portion 234 arranged to operatively contact a knocker arm 236 pivotally mounted on a pin 238 carried by a flange projecting from the base plate 22.

The knocker arm 236 is biased by the spring 138 so as to maintain an end portion 244 thereof in operative engagement with the end portion 234 of the actuating arm, while another end portion 246 of the knocker arm 236 has adjustably mounted therein a knocker bolt 247 which may be actuated by the portion 234 of the actuating arm into an operative engagement with the ends 301 and 301A of the slidable main and address code posts 260 and 260A, 260B and 260C carried by the outer wheel elements 40 and 42 of the code wheel assembly 38.

Code Wheel Assembly

The code wheel assembly 38, as shown structurally in FIG. 1 includes a plurality of primary or main locking code posts 260 and a plurality of secondary or auxiliary code posts 260A, as hereinafter described, slidably mounted in openings, in the outer wheel element 40 and openings in the outer wheel element 42. Each of the main code posts 260 includes a member 261 positioned intermediate the opposite ends thereof having indented flat portions 262 and 264 arranged in spaced relation one hundred eighty degrees apart. The indented portions 262 and 264 may be selectively positioned so as to so cooperate with a flange portion of the inner wheel element 48 having indent portions 267 so arranged as to permit the inner wheel element 48 upon adjustment of the code post 260 in one sense to move free of the outer wheel elements 40 and 42 against the light biasing force of the coupling spring 50, as explained in the copending U.S. application Ser. No. 371,072.

The inner wheel element 48, as best shown in FIG. 1, includes the flange portion having the indent portions 267 arranged to cooperate with raised portions 269 and 270 of the member 261 so as to lock the inner wheel element 48 in operative relation with the outer wheel elements 40 and 42 upon the main code post 260 being adjusted in a neutral position, shown in FIG. 1, or longitudinally to the left of FIG. 1, in response to an improper code bit.

The member 261 of the main code posts 260 has flange portions 271 and 273 positioned in spaced relation and so arrangged as to be operatively engaged by release springs having spring legs 275 and 277. The springs are secured to the outer wheel elements 40 and 42 by bolts 278 and 279 and are so arranged that opposite end portions 281 and 285 of the spring legs 275 and 277 bear on the flange portions 271 and 273 of the member 261 so as to normally bias the main code posts 260 to the neutral position, shown in FIG. 1 and FIG. 3.

However, upon longitudinal actuation of the main code posts 260 in one sense, for example, to the right of FIG. 1, against the biasing force of spring 275, the member 261 of the main code posts will be adjusted so as to position the indent portion 262 thereof immediately adjacent the outer periphery of the flange portion 265 of the inner wheel 48 so as to release the same from a locking position relative to the outer wheels 40 and 42 and thereupon the outer diameter of the flange of the inner wheel 48 is permitted to pass the code post at the indent portion. Conversely, upon actuation of the main code posts 260 in an opposite sense, for example to the left of FIG. 1, against the biasing force of the spring 277, the code posts may be so positioned that the raised portion 270 of the member 261 of the main code posts 260 is adjustably positioned in the indent portion 267 of the flange portion of the inner wheel element 48 and in locking relation with the inner wheel element 48, as shown for example in FIG. 1, whereupon the outer diameter of the flange portion of the inner wheel is not permitted to pass the code post 260, as explained in the aforenoted U.S. application Ser. No. 371,072.

The code wheel assembly is composed of the outer wheel segments 40 and 42, an inner wheel 48 and twenty-seven code posts. Twenty-four (24) identical code posts are required to aaccommodate the unlocking code in the unit; the remaining three are special posts 260A, 260B and 260C which are used for output switch actuation. Physically, the code posts are supported by the two segments of the outer wheels 40–42 and are located in a circle equally spaced near its periphery. The outer wheel assembly 40–42 is pinned at 46 to the center shaft 34 so that it always rotates with it.

The inner wheel 48 is mounted concentrically within the outer wheel 40–42 and can rotate relative to it. It is locked to the outer wheel 40–42 by way of the code posts 260. Its relationship to the inner wheel 48 and the code post position is established by mechanical stops between the two wheels 40–42 and 48. The light bias spring 50 assures that the wheels are always properly positioned to accept the code posts 260 upon a return to neutral, i.e., locking engagement of the inner wheel 48 after reset, once they have been separated for code output switch actuation.

The two wheels 40–42 and 48 are locked together by the code post 260 at all times when the unit is operative, except for that time when a correct code message has been decoded.

As explained in the aforenoted U.S. application Ser. No. 371,072, the code posts 260 are operated so as to discern between a proper and an improper code bit. Assuming that the code post 260 is set for "Mark" operation pulsing the "Mark" input solenoid will cause the code post 260 to position the post cut-out 262 nearest the inner wheel 48 and directly over the inner wheel 48. That particular code post 260 will then no longer contribute to the locking of the inner wheel 48 to the outer wheel 40–42. However, if instead the space solenoid is pulsed at that same code wheel position, the same code post cut-out 262 would then be moved further away so that code post 260 will remain as a contributor to the interlocking action effected by the code posts between the two wheels 48 and 40–42.

In this connection, it should be borne in mind that the code posts 260 are all preset prior to unit closure so as to represent a series of digital 1 or 0 bits. Each code post is either set for a 1 or a 0 merely by rotating it to either of the two positions, each one hundred eighty degrees away from the other. They are each held in position by a detent 305 under the biasing force of spring 307.

Figure 2:
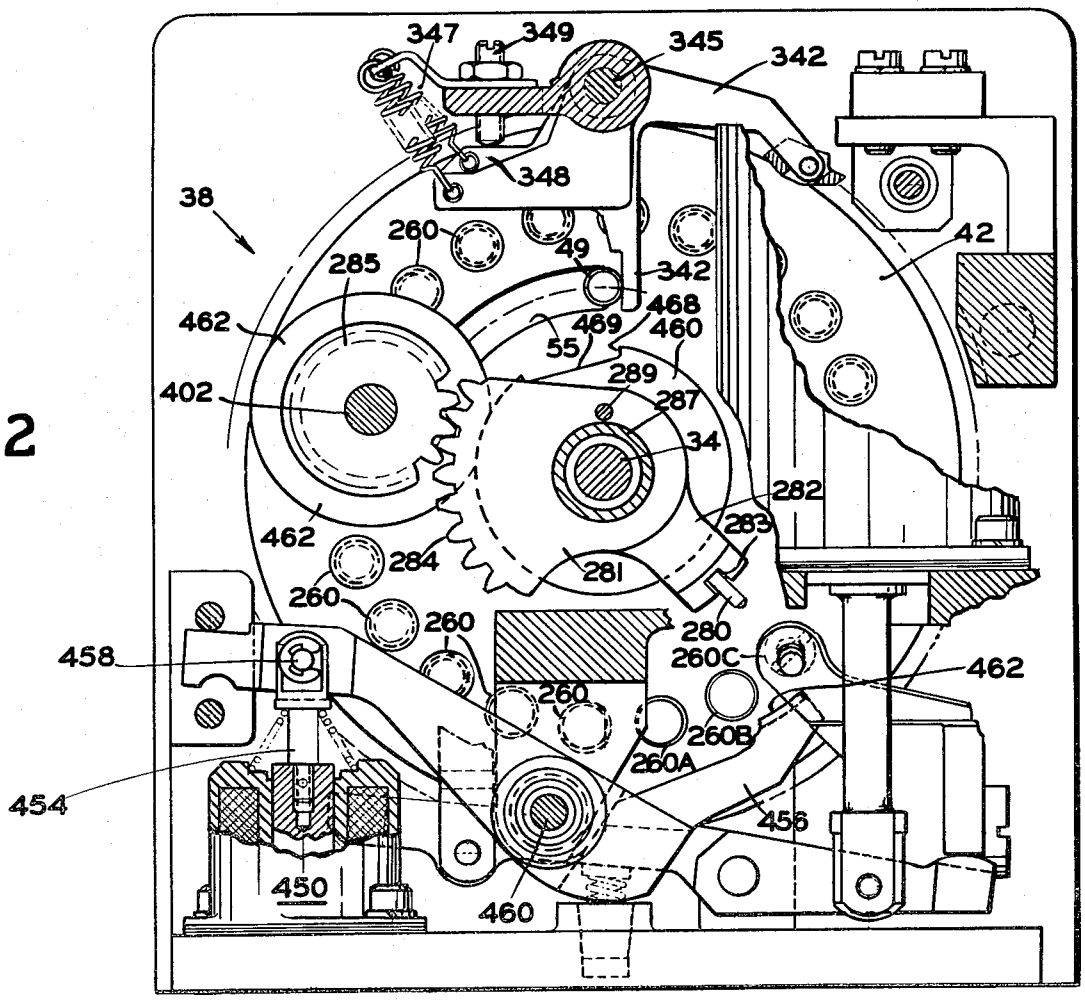
FIG. 2 is a sectional view of FIG. 1 taken along the lines 2—2 of FIG. 1 and looking in the direction of the arrows.

In the illustration of the invention herein provided, the first twenty-four of the main code posts 260 may be of identical structure, while the last auxiliary or address code posts 260A, 260B, and 260C, in the twenty-fifth, twenty-sixth and twenty-seventh positions, as shown in FIGS. 1 and 2, are so constructed as to be in an unlocking relation to the inner wheel element 48 at all times. The code posts 260A and 260C are of identical construction to that of the code post 260B, shown in FIG. 1, except that the code posts 260A and 260C effect no control action and do not include a switch control arm such as the arm 280 which projects from the code post 260B.

A segmental gear element 281 is angularly movable on the shaft 34 and has a flange portion 282 in which there is provided in the periphery thereof an indent or slot 283. The segmental gear element 281 has a toothed portion 284 arranged in engaging relation with a toothed portion of a switch operating gear 285, as shown in FIGS. 1 and 2. Further, a spring 286 is coiled about a hub portion 287 of the gear 281 which is supported by bearings 287A–287B on the shaft 34. The spring 286 biases an arm 287C projecting from the hub portion 287 of the segmental gear 281 into engaging relation with a stop 288 projecting from the end portion 28. The segmental gear element 281 is biased by the spring 286 in a counterclockwise direction, as viewed in FIGS. 1 and 2 about the shaft 34. The spring 286 is connected at one end 289 to the segmental gear 281 and at the opposite end 290 to the end portion 28, as explained in greater detail in U.S. application Ser. No. 372,729.

The member 261A of the auxiliary code post 260B, as shown in FIG. 1, includes flange portions 271A and 273A mounted in spaced relation on the code post 260B and so arranged that the switch control arm 280 projecting from the flange portion 273A may be adjustably positioned through a slot 291 in the outer wheel element 42 into engaging relation in the indent 283 of the flange portion 282 of the segmental gear 281. The control arm 280 is positioned in a disengaging relation to the indent 283 of the flange portion 282 when in the normal neutral position shown in FIG. 1. However, upon a longitudinal movement of the auxiliary code posts 260B to the right, as shown in FIG. 1, the free end of the arm 280 will lock in the indent 283 of the flange portion 282 so as to lock the segmental gear element 281 to the outer wheel element 40–42.

Corresponding parts in the code post 260B to those described with reference to the code post 260 have been identified in FIG. 1 by like numerals bearing the suffix A.

Thus, a nonswitch selecting code signal causing the knocker arm 236 to actuate the code post 260B to the left will cause the code post 260B to remain in an unlocked relation to the indent 283 in the flange portion 282 of the segmental gear 281, while a switch selecting code signal will cause the knocker arm 135 to actuate the auxiliary address code post 260B to the right from the neutral position shown in FIG. 1, into a locking position relative to the indent or slot 283 in the flange portion 282 of the segmental gear element 281. This locking action of the auxiliary code post 260B will then drivingly connect the outer wheel elements 40–42 to the segmental gear element 281 to effect angular movement thereof in a clockwise direction, as viewed in FIG. 2, relative to the inner wheel element 48 to follow the clockwise stop action of the outer wheel elements 40–42 upon the pin 49 engaging the locking arm 342 and the outer wheel element 48, as explained in the aforenoted U.S. application Ser. No. 371,072.

Such clockwise angular movement of the segmental gear element 281 relative to the inner wheel element 48 will in turn effect a selective operation of a switch assembly 400 having an operating shaft 402 drivingly connected through gear 285 to the segmental gear element 281.

The auxiliary address code posts 260A, 260B, and 260C in the twenty-fifth, twenty-sixth, and twenty-seventh positions of the code wheel assembly 38 have a predetermined and fixed relation to a particular switch function, as explained in U.S. application Ser. No. 377,729.

The main code posts 260, however, may be selectively rotated 180° by a remote code change mechanism, shown in FIG. 2, as explained in the U.S. application Ser. No. 328,083, so as to change the operative relation thereof from that shown in FIG. 1. The detent portion 264 would then be operative upon actuation of the main code post 260 to the left to release the inner wheel element 48. While the raised portion 269 would be operative to retain the inner wheel element 48 and the outer wheel elements 40 and 42 in a locked relation upon actuation of the main code post 260 longitudinally to the right.

The actuation of the main code posts 260 in the one and other senses described in reference to FIG. 1 may be selectively effected by the knocker arm 135, and the knocker arm 236, as shown in FIG. 1, and the code wheel assembly 38 may be rotated in a stop action by the pawl actuating mechanism in operative relation with the ratchet wheel on the shaft 34, as explained in the copending U.S. application Ser. No. 371,071.

The auxiliary code posts 260A, 260B, and 260C may be similarly selectively actuated by the knocker arms 135 and 236 from the neutral position shown in FIG. 1, but only the code post 260B carrying the control arm 280 may be actuated so as to position the control arm 280 in a locking relation between the segmental gear 281 and the outer wheel elements 40 and 42 after receipt of a predetermined code signal so as to effect a selective operation of the switch mechanism 400, as explained in the copending U.S. application Ser. No. 377,729, while remaining in an unlocked relation upon receipt of a nonswitch selecting code signal.

Selective energization of the "Mark" and "Space" solenoids control respectively the knocker arms 135 and 236 and the tension applied to the code wheel advance springs. While upon de-energization of the selected solenoid, the energy stored in the code wheel advance spring becomes effective to actuate the pawl actuating mechanism as explained in the U.S. application Ser. No.

371,072 to thereby cause a ratchet wheel carried by shaft 34 to move the code wheel assembly 38 to the next succeeding position with a stop action.

Further, each of the main code posts 260 includes an end portion 300 protruding from the outer wheel element 40 and arranged for selective operation by the end portion 140 of the knocker arm 135, as shown in FIGS. 1, while the opposite end of the main code post 260 includes an end portion 301 protruding from the outer wheel element 42 and arranged for actuation by the end portion 246 of the knocker arm 236, as shown in FIGS. 1 and 2.

In an end portion of the main code post 260, there are arranged longitudinal slots 305, as possibly best shown in FIG. 1. Cooperating with the slots 305 is a ball detent 307 biased by a spring 309 held by a bolt 310 so as to releasably resist angular rotation of the main code post 260 and thereby maintain the same in an angularly adjusted position in the outer wheel elements 40 and 42.

Further, at the end portion 300 of the main code posts 260, there is provided, as shown in FIG. 1, a flange portion 311 and indent portions 312 and 314 arranged in spaced relation so as to cooperate with a locking detent member 316, as shown in FIG. 1, upon actuation of the main code posts 260 in one or the other of the longitudinal senses as illustrated and explained in the U.S. application Ser. No. 306,792, and in the U.S. application Ser. No. 328,083.

The auxiliary code posts 260A, 260B, and 260C, as shown in FIG. 1, have arranged in cooperative relation with a locking detent 316A a similar flange portion 311A and indent portions 312A and 314A to that of the main code posts 260. Corresponding parts are indicated in the auxiliary code posts 260B by corresponding numerals to which has been added the suffix A for the parts of the auxiliary code posts 260B.

Each of the locking detent members 316 are pivotally mounted by a bolt 318 in the outer surface of the outer wheel element 40 and located radially inward of the code posts 260. The locking detent members 316 are biased by a spring 320 so as to bias the end portion 325 of the locking detent member 316 into cooperative engagement in the indent portion 312 or 314, as the case may be, upon longitudinal actuation of the code posts 260 from the neutral position, shown in FIG. 1, to one or the other of the locking positions. The opposite end portion 327 of each detent member 316 is positioned in a recess 330 formed in the periphery of the reset wheel 56, as shown in FIG. 1, and explained in the aforenoted U.S. application Ser. No. 371,072.

As distinguished from the locking detent members 316 for the main code posts 260, the locking detent member 316A for the auxiliary code post 260B, as shown in FIG. 1, is pivotally mounted by a bolt 318A secured in the outer surface of the outer wheel element 40 and located radially outward of the code post 260A. The locking detent member 316A is biased by a spring 320A having one end engaged in the outer surface of the wheel element 40 and another end bearing on the detent member 316A so as to bias the end portion 325A of the locking detent member 136A into cooperative engagement in the indent portion 312A or 314A, as the case may be, upon longitudinal actuation of the code post 260B from the neutral position, shown in FIG. 1, to one or the other of the locking positions.

The code posts 260A and 260C have a corresponding detent locking structure and the opposite end portion 327A of each of the detent members 316A for the code posts 260A, 260B, and 260C extends beyond the perimeter of the outer wheel element 40, and is arranged in cooperative relation with an end portion of a pivotal spring biased detent release pawl, as explained in copending U.S. application Ser. No. 371,072.

Further, as shown in FIGS. 1 and 2, there projects from the inner wheel element 48 a pin 49 which extends through the arcuate slot 55 in the outer wheel element 42 into engaging relation with a stop arm 342 pivotally mounted on a bolt 345 projecting from the end plate 28, as shown in FIG. 1 so as to limit the extent of angular movement of the code wheel assembly 38 in a clockwise direction by the stepping action of the pawl mechanism.

Thus, in the event the outer wheel elements 40 and 42 remain in a locked relation with the inner wheel element 48 following receipt of a faulty decoding message, the pin 49 operatively engages the stop arm 342 which is biased into operative engagement therewith by a spring 347. The spring 347 normally holds a portion 348 of the arm 342 in abutting relation with a stop bolt 349, as shown in FIG. 5. The force asserted by the code wheel advance spring is sufficient, however, to overcome the biasing force of the spring 347 whereupon the arm 342 effects a step operation of a counting mechanism, as explained in the U.S. application Ser. No. 371,072, which is thereafter effective to lock the decoding mechanism from further operation until a return to the safe, home, or null position, as therein explained.

Furthermore, after a predetermined number of unsuccessful attempts to operate the decoder mechanism, the counting mechanism will render effective a timer to render the operating mechanism for the decoder unit ineffective over a predetermined time interval, as therein explained.

However, upon a proper decoding message being received by the decoder unit causing the locking posts 260 to be selectively actuated so as to unlock the inner wheel element 48 from the outer wheel elements 40 and 42 and permit free angular movement of the outer wheel elements 40 and 42 relative to the inner wheel element 48 upon the completion of the decoding message at which time the pin 49 of the inner wheel element 48 operatively engages the stop arm 342, the biasing force asserted by the spring 347 is sufficient to hold the stop arm 342 against the biasing force of light coupling spring 50 while the biasing force asserted by the code wheel advance spring is sufficient to overcome the resilient force applied through the light coupling spring 50 to the inner wheel element 48 so as to permit further angular movement of the outer wheel elements 40 and 42 relative to the inner wheel element 48 held by the stop arm 342.

Thus, the inner wheel element 48 is held by the pin 49 engaging the stop 342 under the biasing force of spring 347 while the outer wheel elements 40 and 42 of the code wheel assembly 38 may continue to be driven by the step actuating pawls while the pin 49 is arcuately movable in the slot 55 and the control arm 280 may be adjustably positioned through the slot 29 so as to lock the segmental gear 282 to the outer wheel element 40–42 to effect the desired operation of the selector switch 400.

The code post 260B, as shown in FIG. 1, is so arranged that, in the neutral position, the same is held in unlocked relation to the segmental gear element 281. Thus, a code signal selectively applied, for example, through the "Space" solenoid so as to cause the knocker arm 236 to actuate code post 260B in a longitudinal sense to the left will cause the code post 260B to remain in an unlocked relation with respect to the segmental gear element 281. However, if a code signal is applied, for example, to the "Mark" solenoid so as to cause the knocker arm 135 to actuate code post 260B in an opposite longitudinal sense to the right so as to cause the member 261A to actuate the control arm 280 projecting from the flange portion 273A into locking relation with the indent portion 283 of the flange portion 282 of the second inner wheel element 280, such action will cause the code post 260B to lock the segmental gear element 281 to the outer wheel elements 40 and 42. This action will then prevent any further angular advance of the outer wheel elements 40 and 42 relative to the segmental gear element 281 under the biasing force of the code wheel advance spring, while permitting the angular movement of the outer wheel elements 40 and 42 relative to the inner wheel element 48.

In the event that the twenty-fifth, twenty-sixth, and twenty-seventh code signals are properly applied, the outer wheel elements 40 and 42, together with the shaft 34 are step actuated by the selective actuation of the stepper pawls so as to effect selective operation of the control switch mechanism 400, as hereinafter explained.

The selective actuation of the "Space" and "Mark" solenoids will provide the required decoding message to effect the unlocking action of the main code posts 260 of the outer wheel elements 40 and 42 relative to the inner wheel element 48 as well as the selective actuation of the address auxiliary code posts 260A, 260B, 260C to effect selective operation of the control switch mechanism 400, as hereinafter explained. The selective actuation of the "Space" and "Mark" solenoids effecting the decoding message may be provided by the selective operation of suitable switches controlling energizing circuits for the respective solenoids, as explained in the aforenoted U.S. application Ser. No. 371,072.

Selective Switch Control Mechanism

Upon the outer wheel elements 40 and 42 being unlocked from the inner wheel element 48, the further angular adjustment of the outer wheel elements 40 and 42 relative to the inner wheel element 48 through the pawl actuating mechanisms causes the shaft 34 to be angularly adjusted so as to in turn control the rotary switch assembly 400 upon the switch control arm 280 being actuated into a driving relation with the segmental gear element 281 as the code posts 260A, 260B, and 260C are sequentially actuated, as herein specified.

The switch assembly 400 includes a shaft 402 rotatably supported by bearings 422, 423 carried by a casing 425 and an end plate 427 of the switch assembly, as shown in FIG. 1. Fastened to the shaft 402 by splines 427 is an annular member 429 formed of a suitable electrical insulating material having annular ribs 431, 433, 435, and 437. Embedded in the electrical insulating material 429 and between the ribs 431–433, 433–435, and 435–437 are segmental conductors, 440, 442, and 444, respectively, arranged so as to cooperate with spring contact brushes 445–447, 449–450, 451–453, respectively, embedded in suitable electrical insulating blocks secured in the casing 425 as disclosed and claimed in U.S. application Ser. No. 377,729.

The operative arrangement of one pair of the spring switch contacts 445–447 in relation to the segmental switch contactor 440 is shown in the U.S. application Ser. No. 377,729, while the other pairs of spring contacts 445–447, 449–450, 451–453 are similarly arranged in relation to the respective segmental contacts 440, 442, and 444, as explained therein.

The arrangement is such that the switch arms 445–447, 449–450, and 451–453 are effective to close the segmental contacts 440, 442, and 444, respectively, upon the shaft 402 being angularly adjusted to a predetermined position, such as, for example, the 27th bit position of the code wheel assembly 38 as sensed by the angular adjusted position of the shaft 402 of the switch assembly 400 through the segmental gear 281 and gear 285 connected to the operating shaft 402 of the switch assembly 400.

Locking Mechanism for the Output Assembly

Without the locking features hereinafter described, a seizure of either bearing 287A or 287B might possibly cause the segmental gear 281 to drive the switch operating gear 285 so as to cause an inadvertent closure of the switch assembly 400 before a decoding operation of the code wheel assembly 38 has been completed. This possible malfunction during the decoding portion of a message (correct or incorrect) i.e., up to and including the 24th decoding step is prevented by the provision of a pair of novel scalloped discs 460 and 462, shown in FIG. 1 and described in detail in the copending U.S. application Ser. No. 377,729. The scalloped disc 460 is drivingly connected to the shaft 34 and outer wheel elements 40–42 by the pin 46 and would be driven by the code wheel through the twenty-four steps. Through these twenty-four steps, an uninterrupted circumferential edge of the disc 460 driven by shaft 34 remains in engaging relation in a scallop formed in the disc 462 which is keyed to the operating shaft 402 of the switch assembly 400. The engagement of disc 460 in the scallop of the disc 462 acts to prevent actuation of the operating switch shaft 402 due to extraneous mechanical transients such as shock, vibration, or mechanical failure.

Moreover, in the event of a failure of the pin 46 connecting disc 460 to shaft 34, a redundant locking effect is provided through the action of the arm 287C of segmental gear 281 which is held under the biasing force of the torsion spring 286 against the frame stop 288, as shown in FIG. 1. In such case, the segmental gear 281 is locked in toothed engagement with the switch operating gear 285 connected to the operative shaft 402 of the switch assembly 400 so as to prevent actuation of the switch operating shaft 402 throughout the twenty-four decoding steps of the code wheel assembly 38. Upon completion of the decoding message, i.e., the twenty-four decoding steps, the outer wheel 40–42 of the code wheel assembly 38 is unlocked from the inner wheel 48 and is thereupon free to rotate upon receipt of the next successive steps. Upon completion of the 25th decoding step and actuation of the blind auxiliary code post 260A, together with the subsequent stepping action of the shaft 34, the scalloped disc 460 is thereupon so angularly positioned by the step actuation of the shaft 34 that a leading edge of the scallop provided in the disc 460 is positioned at least half way within the scallop in the disc 462, as explained in the copending U.S. application Ser. No. 377,729, so as to thereby free the disc for angular adjustment upon the next succeeding twenty-sixth and twenty-seventh decoding steps, as hereinafter explained.

In this connection, it should be noted, however, that up to this point, no rotation of the switch operating shaft 402 has been possible since the switch operating arm 280 has not as yet been brought into operative engagement in the detent 283 of the segmental gear 281. The code post 260B carries the switch operating arm 280 so that when the code post 260B is actuated (26th step) by the "Mark" solenoid operated knocker arm 135, the code post 260B is shifted longitudinally toward the right, as shown in FIG. 1, so as to cause the switch control arm 280 to engage in the slot 283 of the segmental gear 281 which is thereupon step actuated in a clockwise direction, as viewed in FIG. 2, upon completion of the 26th step, at which time the disc 460 keyed to the shaft 34 will also be actuated in a clockwise direction so as to reposition the scallop 469 in a clockwise direction into cooperative relation with the disc 462 so as to permit the free actuation thereof.

Thus, at the completion of the 26th step, the operating shaft 402 of switch assembly 400 has been rotated approximately one half the required motion to effect switch closure. Thereafter, motion imparted by the segmental gear 281 through the switch operating gear 285, in the succeeding 27th step, completes the required motion of the shaft 402 to effect closure of the switch assembly 400 in which the spring switch arms 445–447, 449–450, and 451–452 are effective to close the respective switch segments 440,442, and 444.

A further feature of the invention includes a segmental flange 475 carried by the inner wheel 48 adjacent the flange portion 271A of the code post 260B and arranged to limit actuation of the code post 260B longitudinally to the right so as to prevent engagement of the control arm 280 with the segmental gear 281 so long as the outer wheel elements 40–42 are in locked relation with the inner wheel element 48. However, upon the inner wheel elements 40–42 being operatively disconnected from the inner wheel element 48 by the proper code operation of the code posts 260 and thereafter the outer wheel elements 40–42 being angularly adjusted relative to the inner wheel element upon the twenty-fifth step operation, the angular adjustment of the outer wheel elements 40–42 will cause the flange portion 271A to be positioned out of the limiting relation with the flange 475 so as to permit the longitudinal adjustment of the code post 260B to the right on the twenty-sixth step.

However, with an input of an incorrect code message or prior to angular movement of the outer wheel elements 40–42 relative to the inner wheel element 48, the segmental flange 475 remains in the limiting relation with the flange portion 271A of the code post 260B thereby restricting its motion.

Figure 4A:
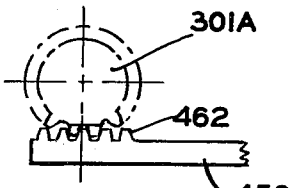
FIG. 4A is an end view of the rack and pinion of FIG. 4.
Figure 4:
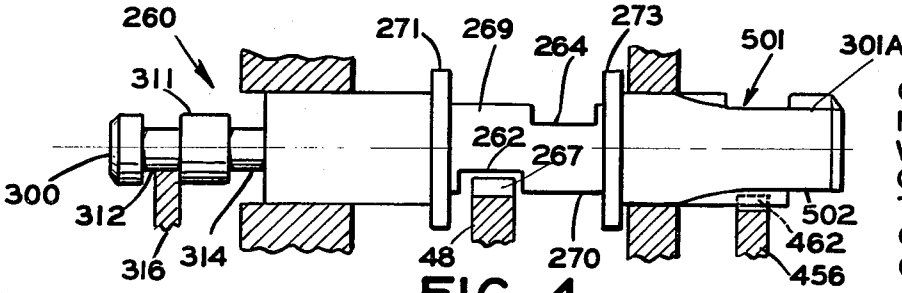
FIG. 4 is a diagrammatic view of the code post 260 in a "mark" position and with a "mark" angular orientation.

It will be seen then that the segmental flange 475, as well as the scalloped discs 460 and 462 which serve to normally prevent inadvertent switch actuation will be disengaged at the completion of the 25th advance step. The 26th and 27th bit steps serve, respectively, to initiate and complete the actual closure of the switch assembly 400. Insertion then of a "Mark" bit at the 26th bit position causes the knocker arm 135 to actuate the special code post 260B at that station and thereby the switch control arm 280 into engaging relation in the slot 283 of the switch actuating arm or segmental gear 281. Once thus engaged, the segmental gear 281, gear 285, and shaft 402 are coupled to the outer wheel elements 40–42 of the code wheel assembly 38 so as to drive the output switch mechanism 400 to a closed position, as shown at FIG. 4.

The three circuits controlled by the switch assembly 400 are protected from shorting one to another by dielectric barriers molded as an integral part of the commutator. Each of the three circuits will have a pair of redundant brushes, i.e., one more set of brushes than is normally required to safely carry the applied electrical load to the electrical device controlled thereby. In all three circuits, the total number of brushes, providing a common contact function in a particular circuit, will be connected in parallel. The redundant brush in each set of contacts will provide reliable switch operation in the event of an electrical failure or intermittent in any one of the remaining brushes. The same redundancy approach will be used for the external leads to the switch circuits.

Novel Code Change System

The aforedescribed structure provides subject matter claimed in the copending U.S. applications Ser. No. 371,072 and Ser. No. 377,729, in which a code capability may be effected by providing a pinion gear 301 at one end of each code post 260 and by further providing a mating sector gear 462 at the free end of a lever arm 456 pivotally mounted on a pin 460 carried by the base 24 and operatively connected to a rod or plunger 454 by a pin 458 which may be actuated upon energization of a solenoid 450, as shown herein at FIG. 2, and in detail in FIGS. 5, 6, 7, 8, 9 and 10 of the copending U.S. application Ser. No. 328,083 filed Dec. 4, 1963, by Peter J. Caruso.

In such arrangement when a change in the code function of a particular code post 260 is required, the necessary one hundred and eighty degree rotation of that post is accomplished by:

(1) Activating the sector gear 462 to a point at which its pitch diameter is tangent to the pitch diameter of the pinion 301 (mesh position);

(2) Rotating the wheel assembly one step so that the code post pinion 301 rotates one hundred and eighty degrees in passing over the sector gear 462.

In one form of the code change mechanism of FIG. 2, actual code change command sequence may be accomplished by the "differential" method heretofore described, while in the second code change device to which the present invention is directed the change in the code may be effected by a "full code" change method, as hereinafter described.

The first utilizes a difference between the present and the new code, thereby setting the new code in the unit by changing only those code pests which are not sequentially correct for the new code. Although this method has some advantages, it has a particular disadvantage in that any transient or error in the code change procedure results in an "unknown" code being impressed in that unit. With the code thus no longer known, access to the inside of the unit is necessary for reactivation, i.e., setting in a known code.

In the system to which the present invention is directed, the "full code" method uses the insertion of the actual new code to accomplish code change. The advantage lies in the ability to insert the new code repeatedly in case of initial failure to successfully accomplish code change due to its extraneous transient during the operation.

Figure 3A:
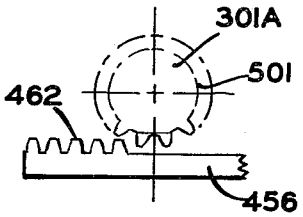
FIG. 3A is an end view of the rack and pinion of FIG. 3.
Figure 3:
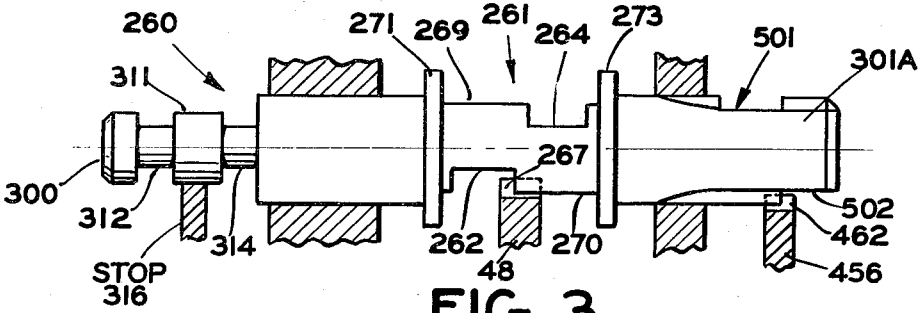
FIG. 3 is an enlarged diagrammatic view of a code post 260 embodying the present invention and set in a neutral position and with a "mark" angular orientation.

In the present invention, to effect the "full code" method, it is required that the code post pinions 301 be modified as indicated at 301A in FIGS. 3, 4, and 5 by removing two small sections 501 and 502 of the code post pinions 301A. The cutout sections 501 and 502 are so arranged that when the code post 260 is actuated properly so as to be disengaged from the inner code wheel 48, one of the cutout sections 501 or 502 dependent on the setting or angular orientation of the code post 260, will be positioned in line with the actuated sector gear 462. FIGS. 3, 4 and 5 illustrate diagrammatically how the "full code" change system operates.

In the view of FIG. 3, the code post 260 is shown in a neutral position and arbitrarily preset or angularly oriented for correct longitudinal actuation in a "Mark" sense to unlock the inner wheel 48. The sector gear 462 is shown in FIG. 3A in a position to mesh with the pinion 301A and therefore as the new code requires a "Space" oriented bit in this particular station, the "Mark" solenoid may be pulsed to actuate the code post 260 longitudinally to the "Mark" position shown by FIG. 4, accordingly. The translation of the code post 260 then places the full gear portion of the pinion 301A in line with the sector gear 462, as shown by FIG. 4A, so that the advance of the wheel assembly to the next station rotates the code post 260 one hundred eighty degrees. The code post 260 is now angularly oriented to the "Space" relation for effecting an unlocking of the inner wheel 48 upon a subsequent longitudinal actuation of the code post 260 in an opposite "Space" sense.

The view of FIG. 4 depicts a longitudinal actuation of the code post in a "Mark" sense to unlock the inner and outer code wheels. In this condition, the "Mark" solenoid, has been pulsed in what is effectively a correct bit actuation to unlock the inner wheel 48, while the toothed portion of the code post pinion 301A engages the sector gear 462, as shown in FIGS. 4 and 4A. The ensuing advance of the code wheel 38 then causes an angular orientation of the code post 260 one hundred eighty-degrees from the "Mark" orientation position to the opposite "Space" orientation position.

Figure 5A:
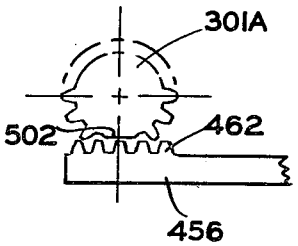
FIG. 5A is an end view of the rack and pinion of FIG. 5.
Figure 5:
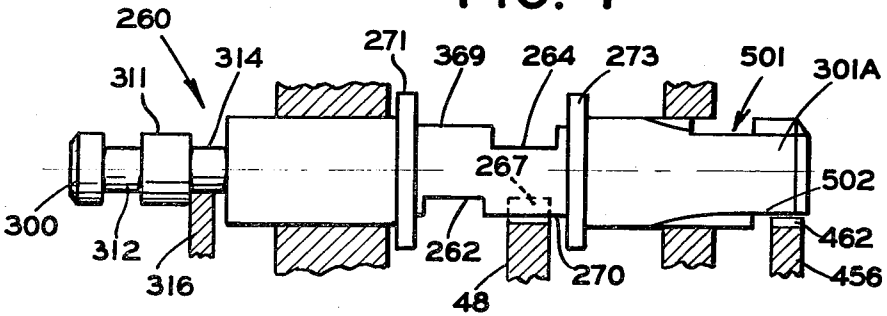
FIG. 5 is a diagrammatic view of the code post 260 in a "space" position with a "mark" angular orientation.

Furthermore, as shown in FIG. 5 upon longitudinal actuation of the code post 260 in a "Space" sense, the code post 260 remains in locking engagement with the inner wheel 48, while the cutout portion 502 of the pinion gear 301A is then positioned over the sector gear 462, as shown in FIGS. 5 and 5A so that in the latter case the ensuing advance of the code wheel 38 will cause no angular orientation of the code post 260 which in that case remains in the required "Mark" orientation position.

The code change sequence is initiated by the insertion of a code change command mesage in the digital code switch. This message consists of the 24 bit code matching the one already present in the unit plus a digital address which requires an "1" to be inserted in the 25th station and "0"'s in the remaining two stations. The outer code wheel 40–42 will be mechanically detended from advancing past the 25th station as long as the code change solenoid 450 is energized. A special code post, similar to the output switch engage code post on the 26th bit station, may be provided to actuate the code change solenoid engage switch.

Therefore, after properly decoding the "already present" code message, actuation of the 25th code post as a mark or "1" bit will close the circuit to the code change solenoid 450 until redirected. With this code change method, the code change sector or rack 462 must be in mesh position with the pinion 301A throughout the code change sequence. This condition may be readily met by using a detent means to successively lock and unlock the rack in and out of mesh position with a single pulse, continuously energize the solenoid 450 to maintain the rack 462 in the engaged position or selectively energize the solenoid 450 to engage the rack 462 for every actuation of code post 260.

Further, having actuated the code change solenoid switch into a closed circuit state for energizing the solenoid 450, as explained in the copending U.S. application Ser. No. 371,072, the reset solenoid is pulsed returning the code wheel assembly 38 to the home position. The unit is now ready to receive the code change input.

The new code consisting of the actual 24 bit code message only is inserted by the selective energization of the desired "Mark" or "Space" solenoids to provide the required "Space" or "Mark" code message, and upon the code insertion cycle being completed, the wheel assembly 38 is reset to home position again. A code change message again consisting of the new 24 bit message plus a "0" bit in the 25th station, is now inserted to determine the validity of the new code input. Proper decode operation will "open" the code change solenoid switch circuit, as explained in the U.S. application Ser. No. 371,072. The unit is then reset to home position and is ready for use.

In the event proper code change has not been effected, the code change mode will not be deactivated, since the code message input would be treated as an incorrect code, thus denying access to the 25th bit station. This action retains the code change solenoid availability and a new code can be alternately inserted and checked until the desired code change is accomplished.

The "full code" method poses a problem of code security which is not present during normal unit operation. Since the actual new code message is used to change from the old code, code messages at this time are subject to possible electromagnetic or other means of detection. This calls for the provision of suitable means for masking or obliterating such solenoid emanations during the code change procedure.

Although only one embodiment of the invention has been illustrated and described, various changes in the form and relative arrangement of the parts, which will now appear to those skilled in the art may be made without departing from the scope of the invention. Reference is, therefore, to be had to the appended claims for a definition of the limits of the invention.

What is claimed is:

1. In a decoder mechanism of a type comprising a code wheel assembly including a first wheel element and a second wheel element, a plurality of code posts normally positioned for locking the first and second wheel elements in driving relation, selectively operable means for longitudinally actuating the code posts in a predetermined sense for unlocking the first and second wheel elements, a means actuated by one of the wheel elements for performing a control function upon the first wheel element being in said unlocked relation with the second wheel element, and means for angularly adjusting said code posts so as to change the predetermined longitudinal sense of actuation for effecting the unlocking of the first and second wheel elements; the improvement comprising a pair of arcuate gear elements mounted in spaced relation on an end portion of each of said code posts and in an opposite angular relation thereon, and the means for angularly adjusting said code posts including a sector gear selectively operable into a position for engaging one of the pair of arcuate gear elements to angularly adjust the corresponding code post and selectively position the gear elements thereon for engagement by the sector gear, each of the pair of arcuate gear elements including first and second cutout portions, one of said cutout portions being so arranged as to cause one of the pair of gear elements after selective engagement by the sector gear to disengage said sector gear upon the longitudinal actuation of the code post in one sense, and the other of said cutout portions being so arranged as to cause the other of said pair of gear elements after selective engagement by the sector gear to disengage said sector gear upon the longitudinal actuation of the code post in an opposite sense.

2. In a decoder mechanism of a type comprising a rotatable wheel assembly including a first wheel element and a second wheel element, a plurality of main code posts slidably mounted in the first wheel element for locking the second wheel element to the first wheel element, a means for selectively actuating the code posts including a first means angularly oriented to a first position to unlock the first wheel element from the second wheel element upon longitudinal actuation of the code post to a first position, and each of the code posts including a second means angularly oriented to a second position to unlock the first wheel element from the second wheel element upon longitudinal actuation of the code post to a second position; the improvement comprising each of said code posts including a pinion at one end having a first toothed sector and a second toothed sector, said first and second toothed sectors being arranged in spaced relation at opposite angular positions about said one end, a sector gear to engage the first toothed sector only of the pinion to effect angular orientation thereof from a first position to a second position so as to render such code post effective only upon the longitudinal actuation of the code post to the first position, and said sector gear being arranged to engage the second toothed sector of the pinion gear to effect angular orientation thereof from the second position to the first position so as to render such code post effective only upon the longitudinal actuation of the code post to the second position.

3. In a decoder mechanism of a type comprising a code wheel assembly including an inner wheel element and an outer wheel element, means for locking the inner wheel element to the outer wheel element in driving relation, means selectively operable for actuating said locking means in locking and unlocking senses, other means selectively operable for changing the locking and unlocking senses of said locking means, and said other means including means effective to transfer from said one unlocking sense to said other unlocking sense; the improvement in which the last mentioned means includes a pinion gear at an end of each of said locking means, said pinion gear having cutout portions to render said transfer means ineffective upon said locking means being first actuated in a sense ineffective to unlock the inner wheel element from the outer wheel element, and said pinion gear including first and second toothed portions being effecive to render said transfer means effective to transfer from said one unlocking sense to said other unlocking sense upon said locking means being first actuated in a sense effective to unlock the inner wheel element from the outer wheel element.

* * * * *